US005853053A

United States Patent [19]

Gilchrist et al.

[11] Patent Number: 5,853,053

[45] Date of Patent: Dec. 29, 1998

[54] STABILIZATION DEVICES FOR DRILL MOTORS

[75] Inventors: David Andrew Gilchrist, Aberdeenshire; Andrew McPherson Downie, Dunfermline, both of United Kingdom

[73] Assignee: Neyrfor-Weir Limited, Scotland, United Kingdom

[21] Appl. No.: 716,386

[22] PCT Filed: Mar. 21, 1995

[86] PCT No.: PCT/GB95/00622

§ 371 Date: Sep. 19, 1996

§ 102(e) Date: Sep. 19, 1996

[87] PCT Pub. No.: WO95/25872

PCT Pub. Date: Sep. 28, 1995

[30] Foreign Application Priority Data

Mar. 22, 1994 [GB] United Kingdom ..... 9405666

[51] Int. Cl.[6] ..... E21B 17/10; E21B 17/16

[52] U.S. Cl. ..... 175/101; 175/325.2

[58] Field of Search ..... 175/101, 107, 175/325.1, 325.2, 76

[56] References Cited

U.S. PATENT DOCUMENTS

| | | | |
|---|---|---|---|
| 3,807,513 | 4/1974 | Kern et al. | 175/107 |
| 4,261,425 | 4/1981 | Bodine | 175/106 |
| 5,452,772 | 9/1995 | Van Den Bergh | 175/101 X |

FOREIGN PATENT DOCUMENTS

| | | | |
|---|---|---|---|
| 4357 | 1/1980 | Cambodia . | |
| 0554977 | 8/1993 | European Pat. Off. . | |
| 2953762 | 12/1983 | Germany . | |
| 395557 | 8/1973 | U.S.S.R. | 175/101 |
| 90/07625 | 7/1990 | WIPO . | |

*Primary Examiner*—David J. Bagnell
*Attorney, Agent, or Firm*—Gifford, Krass, Groh, Sprinkle, Patmore, Anderson & Citkowski,P.C.

[57] ABSTRACT

The invention relates to stabilisation devices for down-hole drill motors and provides such a device comprising a tubular motor body portion (18) adapted for rotational movement on a selective basis to provide a steering capability, a motor shaft (16) passing through the body portion (18). A lower end portion of the shaft provides an end surface (20) for attachment of a tool (32) by a bit attachment means (28, 30) provided within a lower end of the shaft. The lower end of the shaft (16) has an external diameter less than the internal diameter of the motor body portion so as to be either completely or partially received within the body portion to enable the overhang distance between the operating faces of the bit and the stabiliser on the bearing housing to be as short as possible. Alternatively the end face (20) of the shaft may project slightly (≦5 cm) from the end face (22) of the motor body portion (18).

11 Claims, 1 Drawing Sheet

STABILIZATION DEVICES FOR DRILL MOTORS

The invention is concerned with improvements in or relating to stabilisation devices for drill motors, particularly but not exclusively for use with downhole motors for operation in a bore.

Down-hole motors, which may be positive displacement motors, turbo-drills or any suitable motor arrangement for operation within a bore or other confined passage to drive the drill bit, are conventionally fitted with stabiliser devices to guide the motor body, shaft and drill bit in the bore. It will be understood that an un-stabilised arrangement working at operational speeds can partake of a whirling action producing a spiralling motion which can seriously reduce the drilling rate, the effect being particularly severe in the case of certain types of geological formations in which the bore is being formed.

The stabilisers conventionally used comprise a series of vanes machined with or secured to the motor body and usually the bit itself. The gaps between the vanes permit the passage of drilling fluid between the motor and the drilling area.

The motor body is connected to the drilling string which extends back to the surface and a motor shaft is connected to the drill bit itself. The direction of formation of the well bore formed by the rotating bit may be controlled in a number of ways, for example by means of a so-called deviating device, a bend and/or by an eccentric stabiliser kick pad incorporated in the assembly at a suitable position.

During normal drilling the drill string is rotated at a lower speed than that of the drill bit, thereby eliminating the directional influence of the deviating device. Orientated drilling is achieved by aligning the deviating device in the desired direction and then drilling progresses with the drill string held stationary and the bit rotated by the downhole motor.

The rate of change of well bore angle is affected by a number of factors. However, one of the most important parameters is the so-called bit overhang, i.e. the distance from the lower bearing stabiliser on the motor body housing to the operating faces of the drill bit. In general this distance needs to be as short as possible in order to maximise the rate of angle change of the deviating assembly. However, obtaining a smooth well bore profile is important to ensure the drilling assembly can progress in the bore hole at an optimal rate of penetration.

To achieve a smooth bore hole profile the bit must be adequately stabilised usually by means of a stabilising section on the bit gauge. Conventionally a gauge length at least equal to the bit diameter is required, but in general the greater the overhang the larger the gauge length needs to be. Clearly the requirements for a smooth wellbore profile conflict with the requirements for rate of angle change sometimes referred to as the dogleg severity. In practice the construction of the downhole motor and the method of joining the drill bit to the motor shaft conflict with the need to minimise the bit overhang length. Consequently, the bit stabilisation has generally been considered as secondary to the need to achieve the required dogleg severity. Consequently, the performance of motors (ROP) in the orientating mode has been substantially below that achieved when the drilling string is rotated.

Some of the performance reduction is due to the difference in static and dynamic friction coefficients between the drill string and the wellbore. However, a large proportion of the reduction in ROP is due to poor wellbore profile. In a conventional drilling assembly, the motor shaft extending from the motor body is machined internally with a standard bit-box thread. Sufficient length must be allowed for a proper grip of the shaft portion extending from the body, i.e. the internally threaded portion, by a rig tong device for engaging or dis-engaging the drill bit. In addition the bit itself is normally required to allow gripping with a bit breaker.

It will be appreciated that these requirements require a length penalty that conflicts with the desirable dimensions for attaining the maximum rate of change for the deviating assembly.

One solution that has been suggested is described in Applicants' European Patent Specification No. 0554977. This specification describes the provision of a stabiliser secured directly on the bit box of the motor shaft in order to enable the overhang length to be reduced as explained. While this solution is acceptable in many situations, it is sometimes desirable to avoid the presence of a bit box stabiliser particularly in abrasive drilling situations where the leading edge of the stabiliser can suffer premature wear.

The present invention provides in a drill motor assembly of the kind adapted for use in a bore, a stabilisation device comprising a tubular motor body portion adapted for rotational movement on a selective basis to provide a steering capability, a motor shaft passing through said tubular motor body portion, a tool bit attachment means being provided within a lower end portion of the motor shaft, wherein the lower end portion of the motor shaft has an external diameter less than the internal diameter of a lower end portion of the motor body portion so as to be received or at least substantially received therewithin.

Preferably, the lower end portion of the motor shaft may be provided with a shaft end face, said shaft end face being flush with an end face provided on the motor body end portion.

Alternatively, the lower end portion of the motor shaft may be provided with a shaft end face, said end face being received wholly within the motor body end portion.

Alternatively, the lower end portion of the motor shaft may be provided with a shaft end face, the distance by which said end face projects beyond said motor body end portion being no more than 5 cm.

Preferably, the distance may be approximately 1 cm.

Conveniently, the motor end shaft portion may provide a connector portion adapted to receive a tool bit.

Conveniently, said connector portion may be an internally threaded female connector portion.

Advantageously, a drill bit to be attached to said connector portion may be a long gauge bit. It will be appreciated that use may be made of a long gauge bit without the penalty of an increase in bit overhang. Thus the motor output shaft may be gripped by a tool which in turn is gripped by a rig tong device to facilitate making up the drill bit. Alternatively, the motor shaft may be locked to the motor body at a suitable location, the body then being gripped by the rig tong. This gives a considerable advantage over the prior art in which the shaft is gripped directly by the rig tong which involves the provision of unnecessary length on the shaft, thus preventing the desirable reduction in the distance between the commencement of the bit gauge diameter and the motor lower bearing stabiliser.

There will now be described an example of a stabilisation device for a drill motor assembly. It will be understood that the description, which is to be read with reference to the drawings, is given by way of example only and not by way of limitation.

Figure 1:
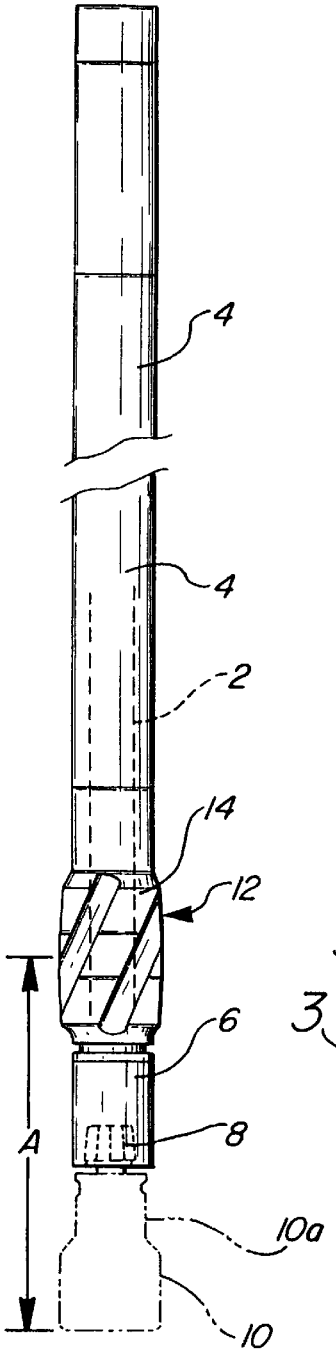
FIG-1 PRIOR ART
FIG. 1 shows an example of an arrangement according to the prior art.

FIG. 1 illustrates a typical arrangement in which a motor shaft 2 is received within a motor body 4, a lower end of the shaft 2 protruding from the body being upset to provide a portion with an enlarged external diameter which forms an attachment means conveniently referred to as a bit box 6. The bit box has an internally threaded portion capable of receiving an externally threaded pin 8 of a tool bit 10.

A stabiliser 12 is provided on the lower end portion of the body 4 and comprises an arrangement of stabilising means 14.

The bit box 6 has a length, typically at least 20 cm, sufficient to allow the shaft 2 to be held firmly with a rig tong when torquing or un-torquing the bit 10. The bit itself has a neck portion 10*a* to permit grasping by a bit gripper or breaker, the length of the neck portion being in the region of 15 to 17.5 cm for this purpose. Typically therefore the overhang dimension conventionally measured as distance A as shown in FIG. 1 may be in the region of 80 cm. This dimension would be appreciably increased if the bit 10 illustrated (18 cm gauge) were to be replaced by a longer bit gauge (say, 30 cm) to ensure the desired smooth bore profile.

Figure 2:
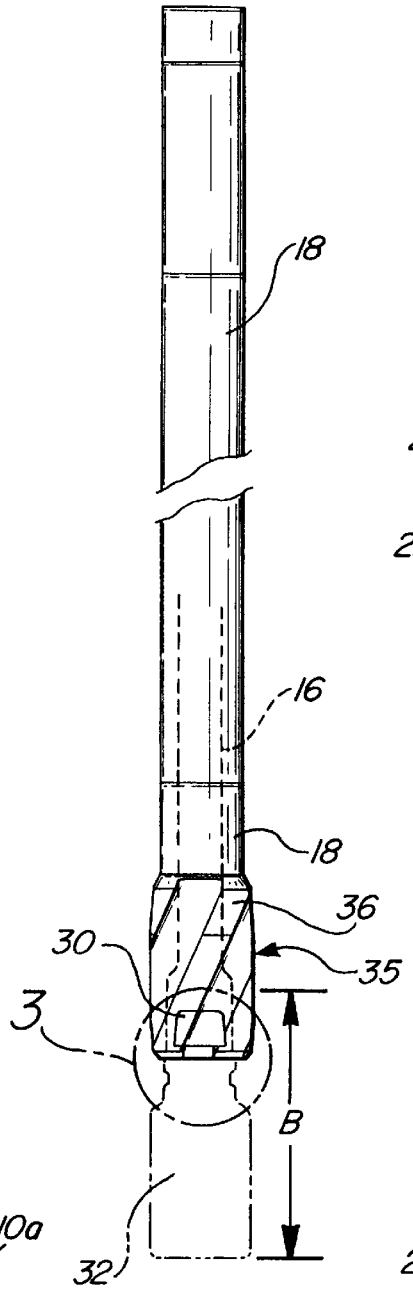
FIG. 2 shows a view of an arrangement according to the present invention.
Figure 3:
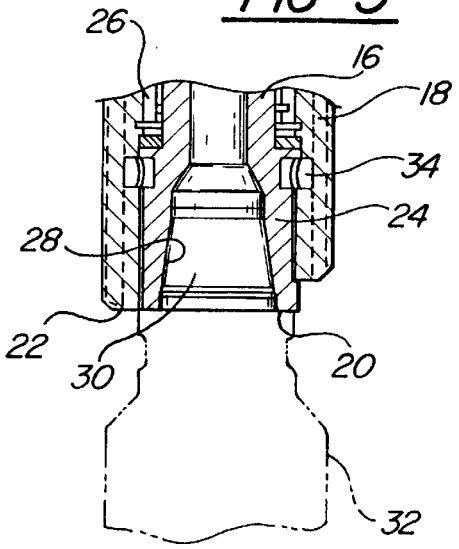
FIG. 3 is a fragmentary view partly in section of a portion of FIG. 2 indicated by an enclosing circle.

FIG. 2 illustrates an example of an arrangement according to the invention. A motor shaft 16 is received within a motor body 18 so as to be completely received within the body, a lower end face 20 of the shaft (FIG. 3) lying flush with a lower end face 22 of the body 18. The lower end portion 24 of the shaft therefore has an external diameter that is slightly less than the internal diameter of the end portion of the body 18 to allow relative rotation in bearing devices, portions of which are shown at 26. The lower end portion 24 of the shaft 16 is provided with an internal thread at 28 into which is received an externally threaded pin 30 of a bit 32. A locking means including locking apertures 34 is provided at a convenient location to lock the shaft against rotation for facilitating the attachment and release of the bit 32 with respect to the shaft. This contrasts with the requirement for an extra length of bit box 6 as shown in FIG. 1 and referred to above.

Figure 4:
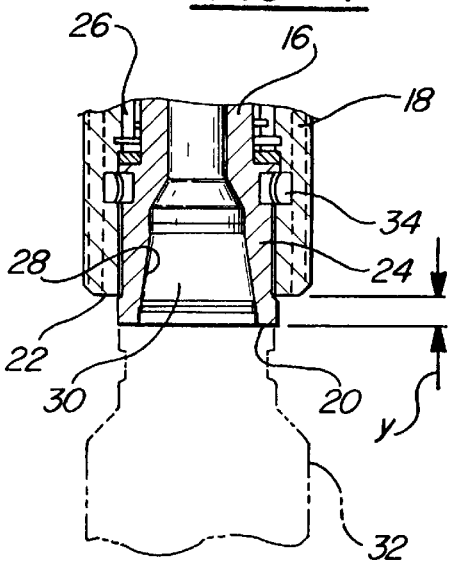
FIG. 4 is a fragmentary view similar to FIG. 3 showing an alternative embodiment of the invention with the projecting end portion of the motor shaft.

Thus, in the present example, locking of the shaft to the body by means of the locking means 34 enables a rig tong to grip the body to facilitate make up of the drill bit. Alternatively, as is shown in the alternative embodiment depicted in FIG. 4, the lower end portion 24 of the motor shaft 16 may project beyond the motor 18 by a distance Y which does not exceed 5 centimeters. Thus, the motor output shaft itself may be gripped by a special tool which is itself then gripped by the rig tongs to prevent the shaft rotating while the bit is being torqued on or off.

A stabiliser 35 is provided on the lower end portion of the motor body 18 in the vicinity of the bearing 26 and comprises an arrangement of stabilising vanes 36. In FIG. 2, the length of the stabiliser 35 is shown by way of example as 38 cm. By contrast the length of the stabiliser shown in FIG. 1 is approximately 30 cm.

Thus the bit overhang dimension B as shown in FIG. 2 is appreciably less, for example B=57 cm, compared with FIG. 1 where A=80 cm. This is despite the use of a long bit gauge in FIG. 2, for example 32 cm compared with 18 cm for the bit 10 of FIG. 1.

As explained above, the example as shown in FIG. 2 gives advantage in having a longer gauge with a shorter overhang distance compared with previous comparable prior art.

Various modifications may be made within the scope of the invention as defined by the following claims.

We claim:

1. In a drill motor assembly of the kind adapted for use in a bore, a stabilisation device comprising a tubular motor body portion adapted for rotational movement on a selective basis to provide a steering capability, a motor shaft passing through said tubular motor body portion, a tool bit attachment means being provided within a lower end portion of the motor shaft, wherein the lower end portion of the motor shaft has an external diameter less than an internal diameter of a lower end portion of the motor body portion so as to be received or at least substantially received therewithin.

2. A device as claimed in claim 1, wherein the lower end portion of the motor shaft is provided with a shaft end face, said shaft end face being flush with an end face provided on the motor body portion lower end portion.

3. A device as claimed in claim 1, wherein the lower end portion of the motor shaft is provided with a shaft end face, said end face being received wholly within the motor body portion lower end portion.

4. A device as claimed in claim 1, wherein the lower end portion of the motor shaft is provided with a shaft end face, the distance by which said end face projects beyond said motor body portion lower end portion being no more than 5 cm.

5. A device as claimed in claim 4, wherein said distance is no greater than about 1 cm.

6. A device as claimed in claim 4, wherein a projecting end portion of the motor shaft is adapted to be gripped by an intermediate tool, the latter being adapted to be gripped by a ring tong device.

7. A device as claimed in claim 1 wherein the motor shaft lower end portion provides a connector portion adapted to receive a tool bit.

8. A device as claimed in claim 7, wherein said connector portion is an internally threaded female connector portion.

9. A device as claimed in claim 1 wherein locking means are provided to lock the motor shaft against rotation relative to the motor body portion when a tool bit is being connected or disconnected thereto.

10. A device as claimed in any one of the preceding claims, claim 1 wherein stabiliser means are provided externally of the motor body portion lower end portion.

11. A device as claimed in claim 10, wherein the stabiliser means comprise an arrangement of stabilising vanes.

* * * * *